US006655918B2

(12) United States Patent
Otsuka

(10) Patent No.: US 6,655,918 B2
(45) Date of Patent: Dec. 2, 2003

(54) IMPELLER OF AXIAL-FLOW BLOWER

(75) Inventor: Shuichi Otsuka, Miyota-machi (JP)

(73) Assignee: Minebea Co., Ltd, Nagano (JP)

( * ) Notice: Subject to any disclaimer, the term of this patent is extended or adjusted under 35 U.S.C. 154(b) by 0 days.

(21) Appl. No.: 10/040,334

(22) Filed: Jan. 9, 2002

(65) Prior Publication Data

US 2002/0102158 A1 Aug. 1, 2002

(30) Foreign Application Priority Data

Jan. 10, 2001 (JP) ..... 2001-002475

(51) Int. Cl.[7] ..... F04D 29/38

(52) U.S. Cl. ..... 416/175; 416/183; 416/200 R; 416/241 A

(58) Field of Search ..... 415/119; 416/183, 416/203, 175, 198 R, 200 R, 241 A

(56) References Cited

U.S. PATENT DOCUMENTS 713,990 A * 11/1902 Keith ..... 416/175
5,925,948 A * 7/1999 Matsumoto ..... 310/67 R
6,138,964 A * 10/2000 Rose et al. ..... 248/123.11
2002/0028146 A1 * 3/2002 Otsuka ..... 417/354

* cited by examiner

*Primary Examiner*—Edward K. Look
*Assistant Examiner*—Dwayne J. White
(74) *Attorney, Agent, or Firm*—Oliff & Berridge, PLC

(57) ABSTRACT

In an impeller of an axial-flow blower driven by an outer rotor type motor, the impeller is formed in sections so that individual impeller sections 5F and 5R can easily be formed by molding with an axial coupling type die, and also which are arranged in series to construct the entire impeller, thereby realizing an impeller structure in which adjacent impeller blades overlap each other. The number of impeller blades of the front section impeller is more than that of the rear section impeller to reduce the noise generated during the rotation of the impeller.

2 Claims, 10 Drawing Sheets

IMPELLER OF AXIAL-FLOW BLOWER

BACKGROUND OF THE INVENTION

1. Field of the Invention

The present invention relates to an improvement of an impeller for an axial-flow blower used in various office automation equipment and the like.

2. Description of the Related Art

Office automation equipments, such as computers or copying machines, have many electronic parts enclosed in the housing thereof, generating excessive heat therefrom, which may destroy the parts. Accordingly, an axial-flow blower is mounted at a ventilation hole provided in the housing to release the interior heat to the outside therefrom.

This conventional type of blower, in this case an axial-flow blower driven by an outer rotor type motor, will be hereinafter described with reference to FIG. 10.

As shown in the drawing, a shaft 4 is rotatably penetrated and supported in a cylindrical section 1*a* at the center of a casing 1 via bearings 2 and 3.

The shaft 4 is mounted at the center of an impeller 5 (the center of a cup section 5*a*) including the cup section 5*a* and a plurality of impeller blades 5*b* at the outer periphery thereof.

The cup section 5*a* has a motor yoke 6*a* molded at the inner periphery thereof, to which a ring-shaped permanent magnet 6*b* is fixed. The permanent magnet 6*b* forms a principle structure of a rotor (an outer rotor) 6 together with the motor yoke 6*a*.

The cylindrical section 1*a* has a stator 7 including a stator core 7*a* and windings 7*b* opposing the permanent magnet 6*b* fixed to the outside thereof. A printed circuit board 8 on which an electronic circuit is mounted for supplying a predetermined current to the stator windings 7*b* to operate the stator 7 and the rotor 6 as a stator and a rotor of a brushless DC motor is attached below the stator 7.

The stator winding 7*b* is connected to the electronic circuit on the printed circuit board 8 with a pin 9. The printed circuit board 8 is connected to a lead wire 10.

In the blower thus constructed, when a power of a predetermined DC voltage is applied to the lead wire 10, a current controlled by the electronic circuit on the printed circuit board 8 flows in the stator winding 7. Accordingly, magnetic flux is generated from the stator core 7*a* to rotate the rotor 6 around the shaft 4 by the mutual magnetic action with magnetic flux from the permanent magnet 6*b*, thereby rotating the impeller 5 integrated with the motor yoke 6*a* of the rotor 6 to blow air.

In this case, the impeller 5 is often made by synthetic resin molding. FIGS. 11 and 12 are a rear view and a partly cutaway left side view, respectively, showing the rotor section of the axial-flow blower including such an impeller 5. In each drawing, same numerals are shown if same with or similar to parts indicated in FIG. 10.

In the case where the impeller 5 of the axial-flow blower as shown in the drawings is formed by synthetic resin molding, an axial coupling type die is used. Accordingly, as shown in FIG. 11, one of the forming conditions is that when the impeller 5 is seen from the axial direction, adjacent impeller blades 5*b* and 5*b* among the impeller blades 5*b* arranged at the outer periphery of the cup section 5*a* at equal angles are set so as not to overlap each other.

In such an axial-flow blower, there is a case in which it is required that the adjacent impeller blades 5*b* and 5*b* overlap each other when looking at the impeller 5 from the axial direction for reasons such as increase of static pressure.

However, according to the conventional art, it is not easy to form such an impeller 5 by synthetic resin molding at low cost because of the above forming conditions, whereby improvements thereto have been required.

Also, in the case where the axial-flow blower is mounted in office automation equipments, which are located in a relatively quiet place, it has been strongly required to take measures to reduce noise generated during the rotation of the impeller (blower).

SUMMARY OF THE INVENTION

The present invention is made in light of the above problems. Accordingly, it is an object of the present invention to provide an impeller of an axial-flow blower having a structure in which adjacent impeller blades overlap each other when seen from the axial direction in an easy procedure and at a low cost even though by synthetic resin molding. In addition to the above, noise generated during rotation can be also reduced.

In order to attain the above object, according to the present invention, there is provided an impeller of an axial-flow blower driven by an outer rotor type motor and integrated with a rotatably supported shaft and a motor yoke, the impeller and the motor yoke rotating outside the stator around the shaft to blow air, wherein the impeller comprises a plurality of individual impeller sections each having a different number of impeller blades, the individual impeller sections being separately formed of a synthetic resin and arranged in series in the axial direction of the shaft.

In the present invention, preferably, among the plurality of individual impeller sections that are adjacent with each other at the front and rear sides in the axial direction of the shaft, the number of the impeller blades of the front section impeller is more than that of the rear section impeller.

DESCRIPTION OF THE PREFERRED EMBODIMENT

An embodiment of the present invention will be hereinafter described with reference to the drawings.

Figure 1:
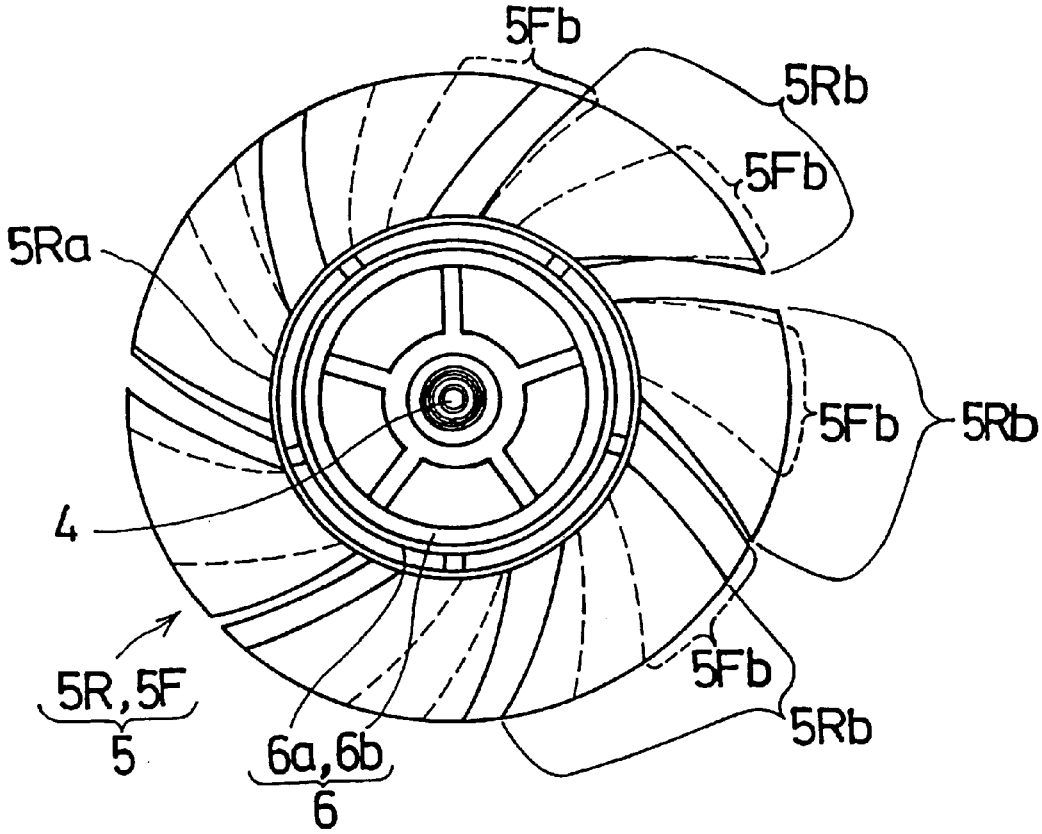
FIG. 1 is a rear view of a rotor section of an axial-flow blower having an impeller according to an embodiment of the present invention.
Figure 2:
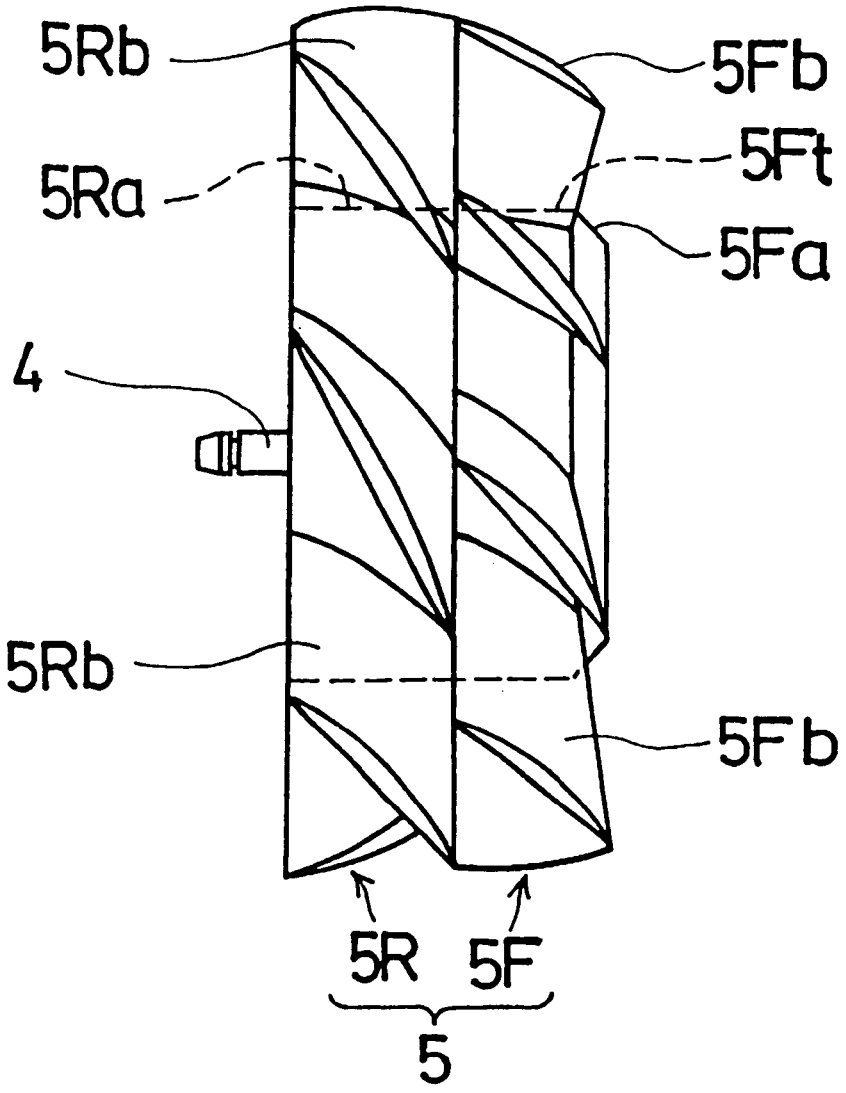
FIG. 2 is a right side view of the rotor section in FIG. 1.

FIG. 1 is a rear view showing a rotor section of an axial-flow blower having an impeller according to an embodiment of the present invention. FIG. 2 is a right side view of the rotor section in FIG. 1.

As shown in the drawing, an impeller 5 of the present invention is constructed in such a manner that a plurality of individual impeller sections, in this case, two stages of individual impeller sections 5F and 5R, are arranged in series in the axial direction of a shaft 4 (the horizontal direction in FIG. 2).

Figure 3:
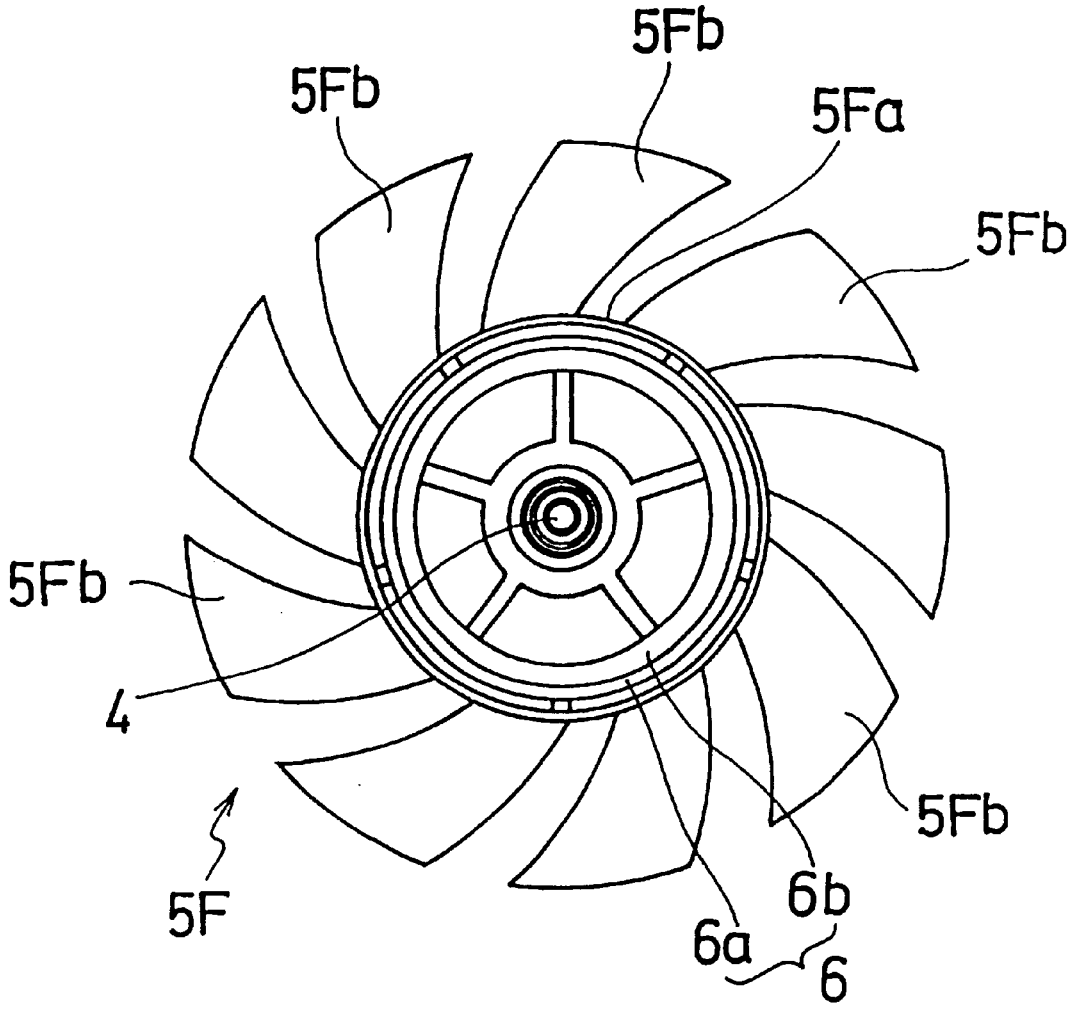
FIG. 3 is a rear view of a state prior to mounting a rear section impeller in the impeller in FIG. 1.
Figure 4:
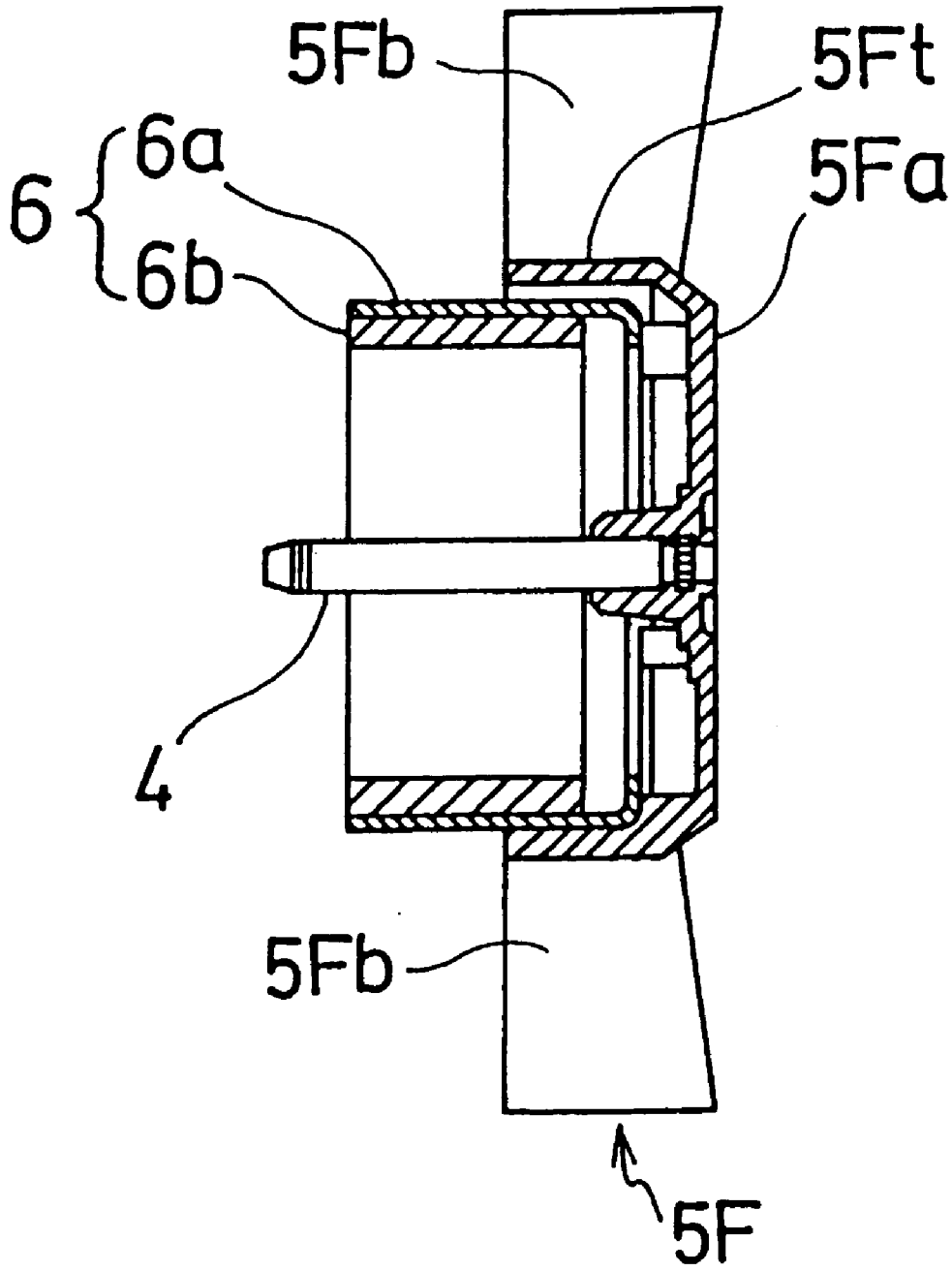
FIG. 4 is a right-side sectional view of an essential part in FIG. 3.

The front section impeller 5F has, as shown in FIGS. 3 and 4, a plurality of impeller blades, in this case, nine impeller blades 5Fb, arranged on a cylinder-shaped cup section 5Fa having a bottom at equal angular spacing on the outer periphery of a cylinder section 5Ft of the cup section 5Fa.

Figure 5:
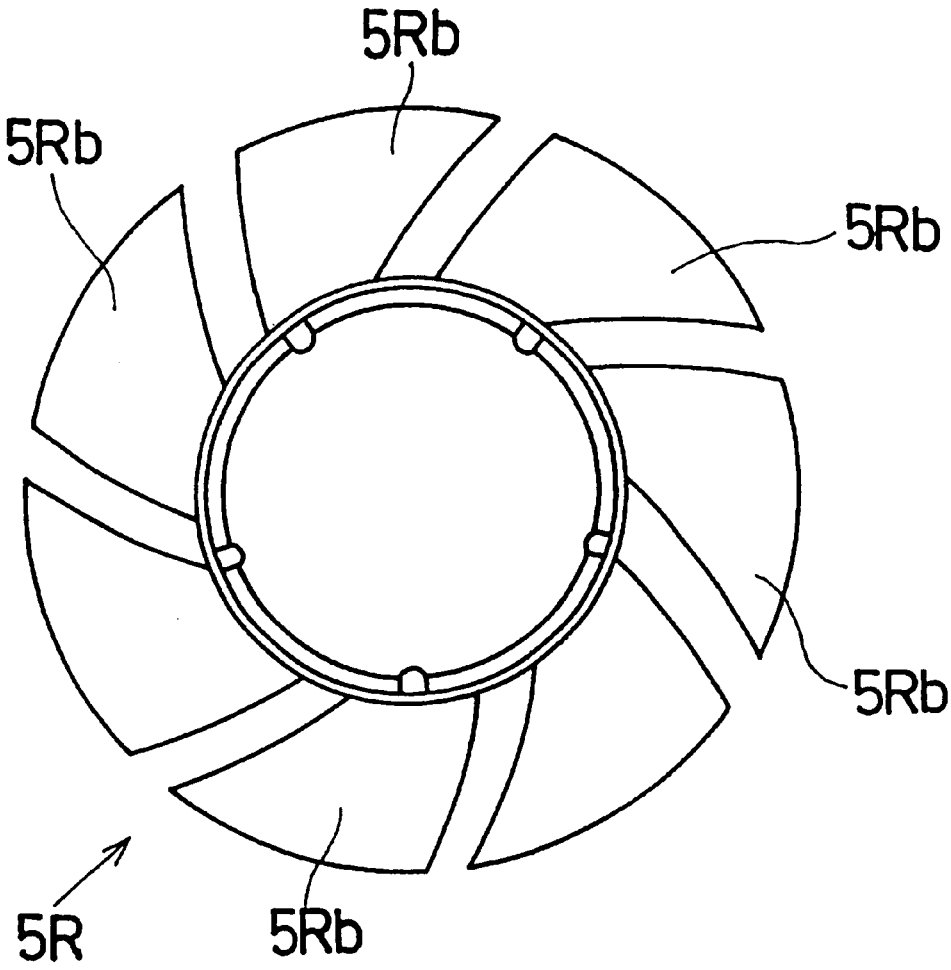
FIG. 5 is a view of the rear section impeller in FIG. 1.
Figure 6:
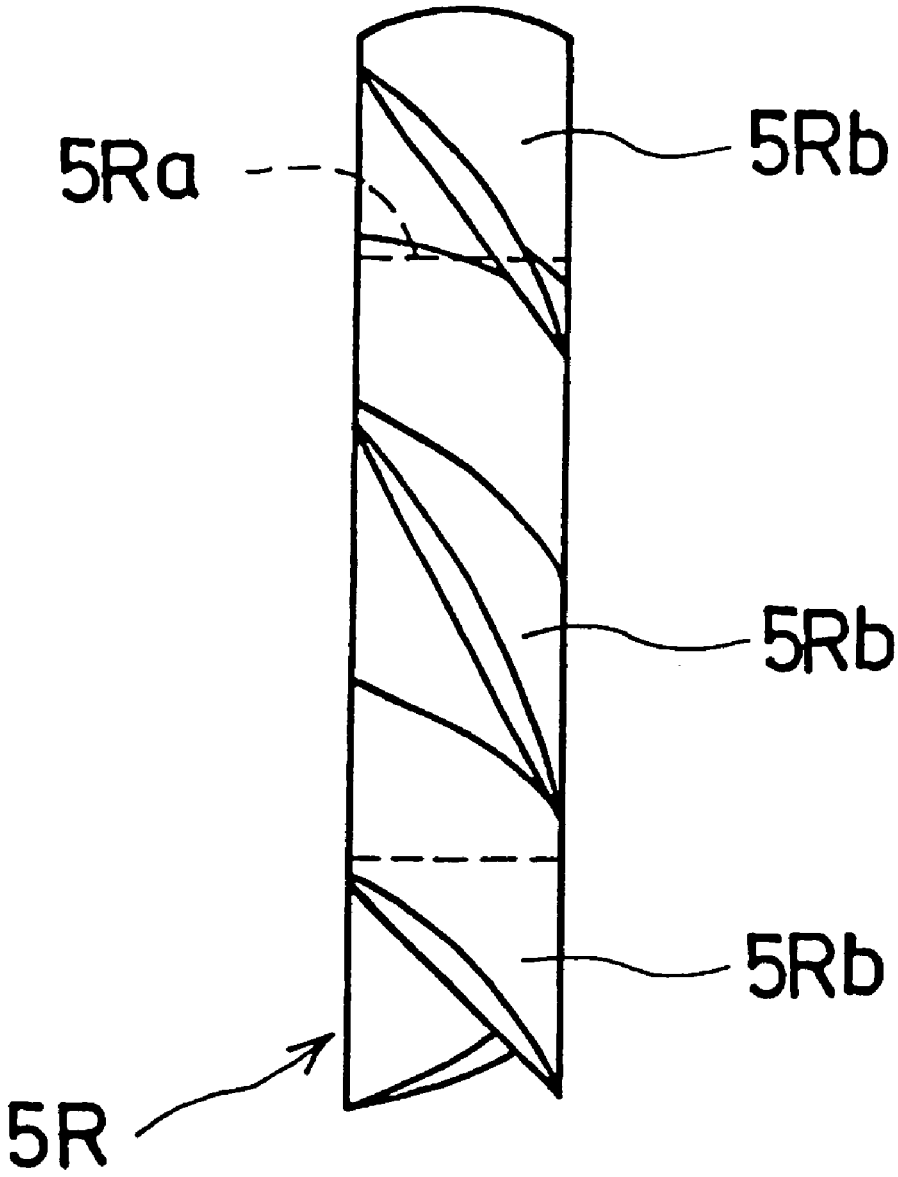
FIG. 6 is a right side view of the rear section impeller in FIG. 5.

In addition, the rear section impeller 5R has, as shown in FIGS. 5 and 6, a different number of impeller blades from that of the front section impeller 5F, in this case, seven impeller blades 5Rb arranged at equal angular spacing on the outer periphery of a cylinder section 5Ra.

The cylinder section 5Ft of the cup section 5Fa of the front section impeller 5F and the cylinder section 5Ra of the rear section impeller 5R are set to have almost the same inner and outer diameter. Accordingly, as described later, when the individual impeller sections 5F and 5R are assembled as the impeller 5 of the present invention, the cylinder section 5Ft of the cup section 5Fa and the cylinder section 5Ra are connected without a step forming one cylinder section with both the cylinders (refer to FIG. 7).

In addition, the individual impeller sections 5F and 5R are separately formed by synthetic resin molding. Here, the adjacent impeller blades 5Fb and 5Fb among the impeller blades 5Fb of the individual impeller 5F are set so as not to overlap each other when seen from the axial direction of the impeller 5F (refer to FIG. 3). With respect to the impeller blades 5Rb of the rear section impeller 5R, the adjacent impeller blades 5Rb and 5Rb are also set so as not to overlap each other when seen from the axial direction of the impeller 5R (refer to FIG. 5). Accordingly, the individual impeller sections 5F and 5R can be easily and cheaply formed by molding with an axial coupling type die.

The individual impeller sections 5F and 5R are assembled, for example, by the following procedure to construct the impeller 5 of the present invention.

First, as shown in FIG. 4, the front section impeller 5F in which the shaft 4 is inserted and fixed at the center part of the inner surface of the bottom of the cup section 5Fa is fixed to a front end portion of an almost cylindrical motor yoke 6*a*. Here, the front end portion of the motor yoke 6*a* is press-fitted in an inner peripheral section of the cup section 5Fa so that the front section impeller 5F is fixed to the motor yoke 6*a*.

Figure 7:
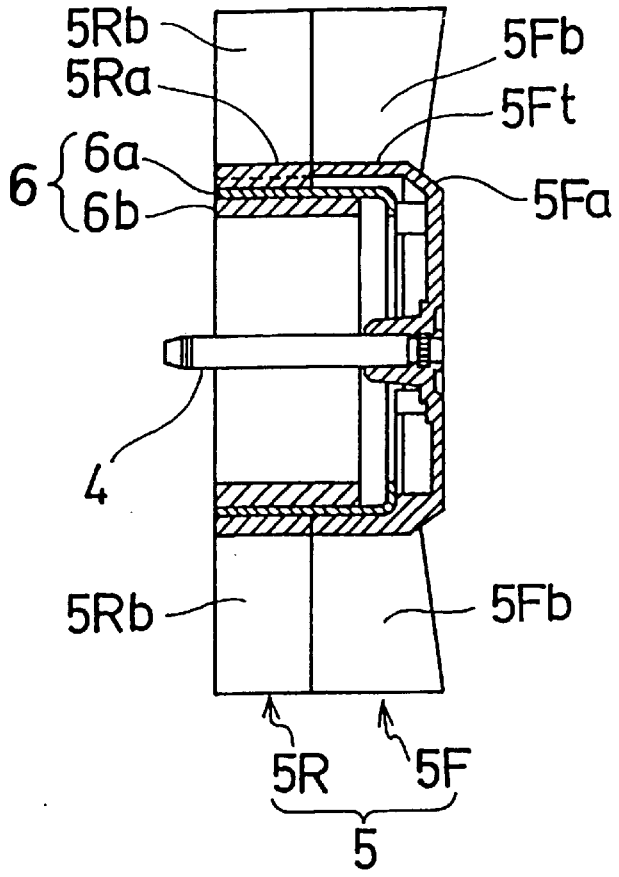
FIG. 7 is a sectional right side view of an essential part showing a state in which the rear section impeller in FIGS. 5 and 6 is mounted on the rotor section in FIGS. 3 and 4 (a completed state)

Subsequently, as shown in FIG. 7, the cylinder section 5Ra is press-fitted to the outer periphery on the rear side of the motor yoke 6*a* so that the rear section impeller 5R is fixed to the motor yoke 6*a*.

In this instance, the front end of the rear section impeller 5R (the cylinder section 5Ra) is brought into contact with the back end of the front section impeller 5F (the cup section 5Fa) so that the cylinder section 5Ft of the cup section 5Fa and the cylinder section 5Ra are assembled to connect without a step so as to form one cylinder section.

In addition, in order to increase the static pressure or the like of the axial-flow blower, some or all of the impeller blades 5Fb of the individual impeller 5F are overlapped with some of the impeller blades 5Rb of the individual impeller 5R when the impeller 5 is seen from the axial direction.

Also, a ring-shaped permanent magnet 6*b* forming a principle structure of a rotor (an outer rotor) 6 together with the motor yoke 6*a* is fixed to an inner periphery of the motor yoke 6*a* (refer to FIGS. 1, 3, 4, and 7).

Figure 8:
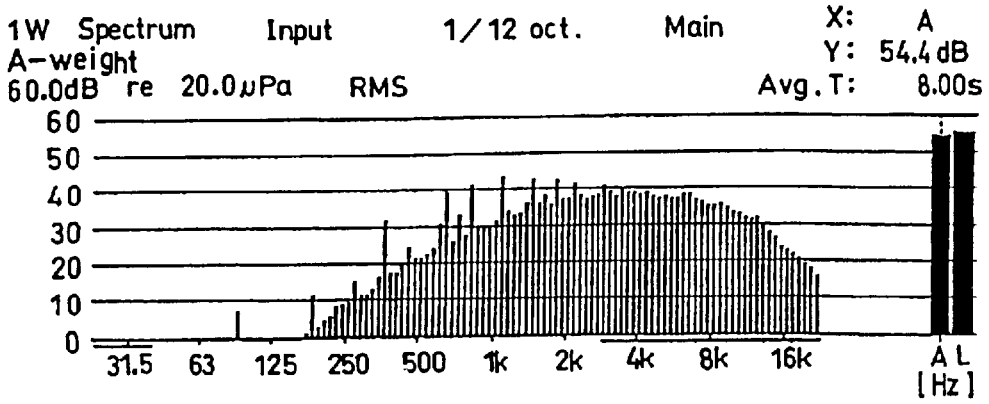
FIG. 8 is a graph of a result of measuring the noise generated daring the rotation of the impeller in the embodiment in FIG. 1.
Figure 9:
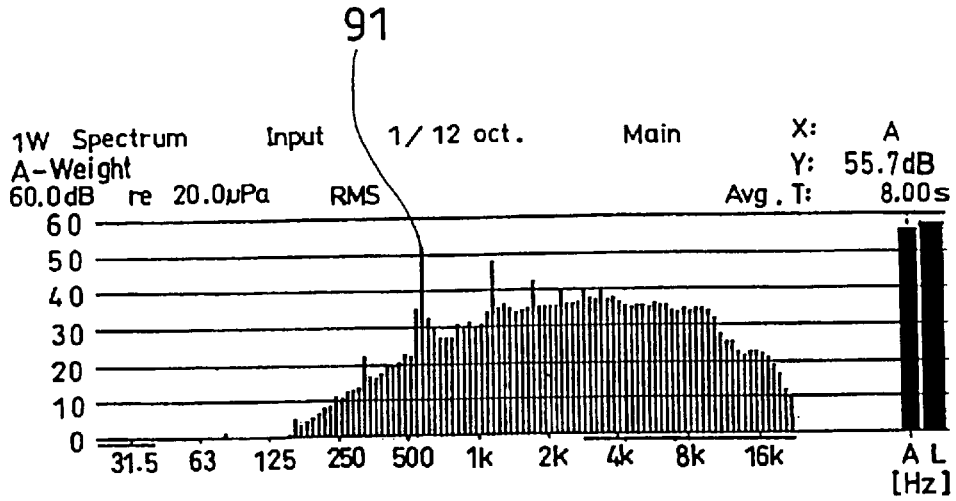
FIG. 9 is a graph of a result of measuring the noise generated during the rotation of the impeller when the number of impeller blades of the front section impeller and that of the rear section impeller are the same.
Figure 10:
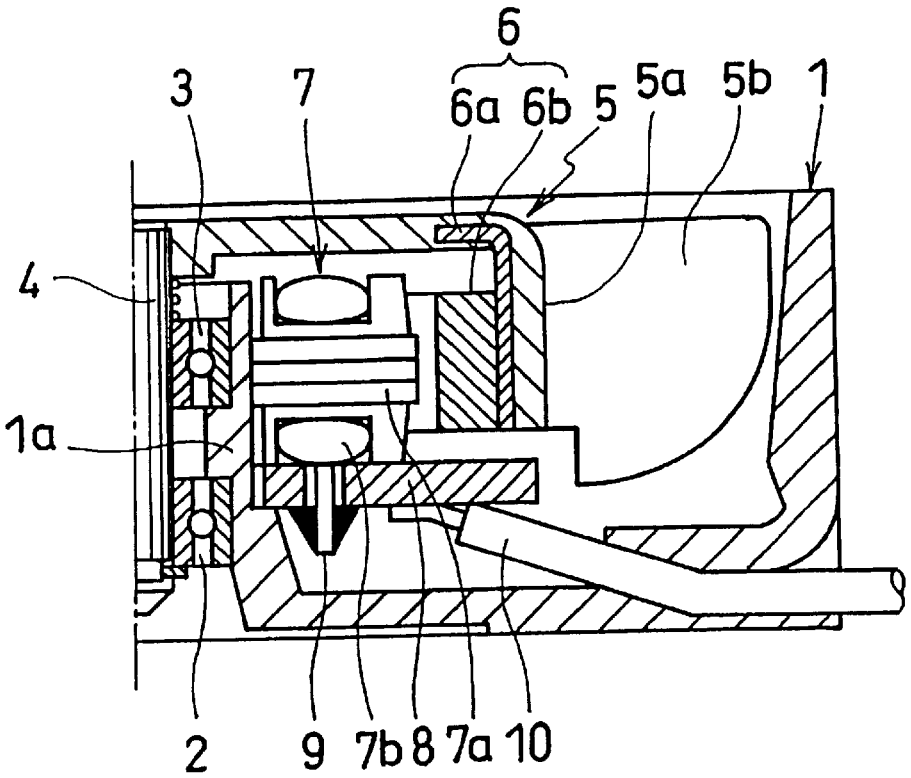
Fig. 10 Prior Art
FIG. 10 is a partly cut-away cross sectional view of a conventional blower.
Figure 11:
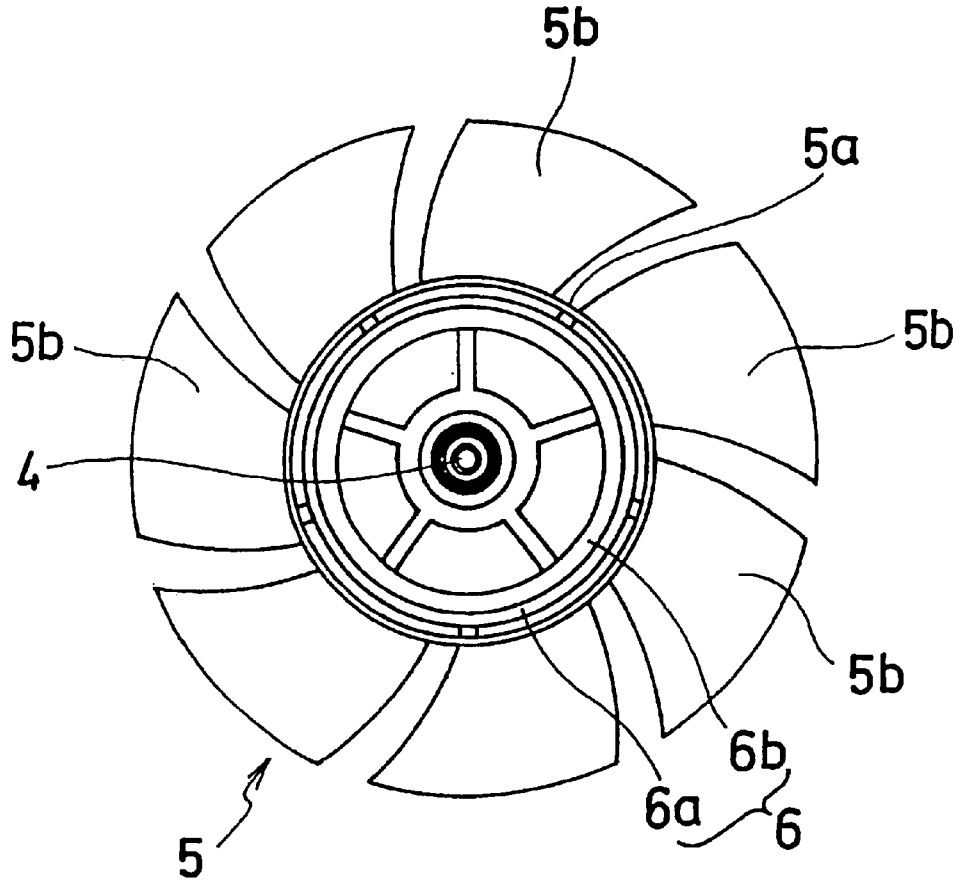
FIG. 11 is a rear view of a rotor section of an axial-flow blower having an impeller formed by synthetic resin molding.
Figure 12:
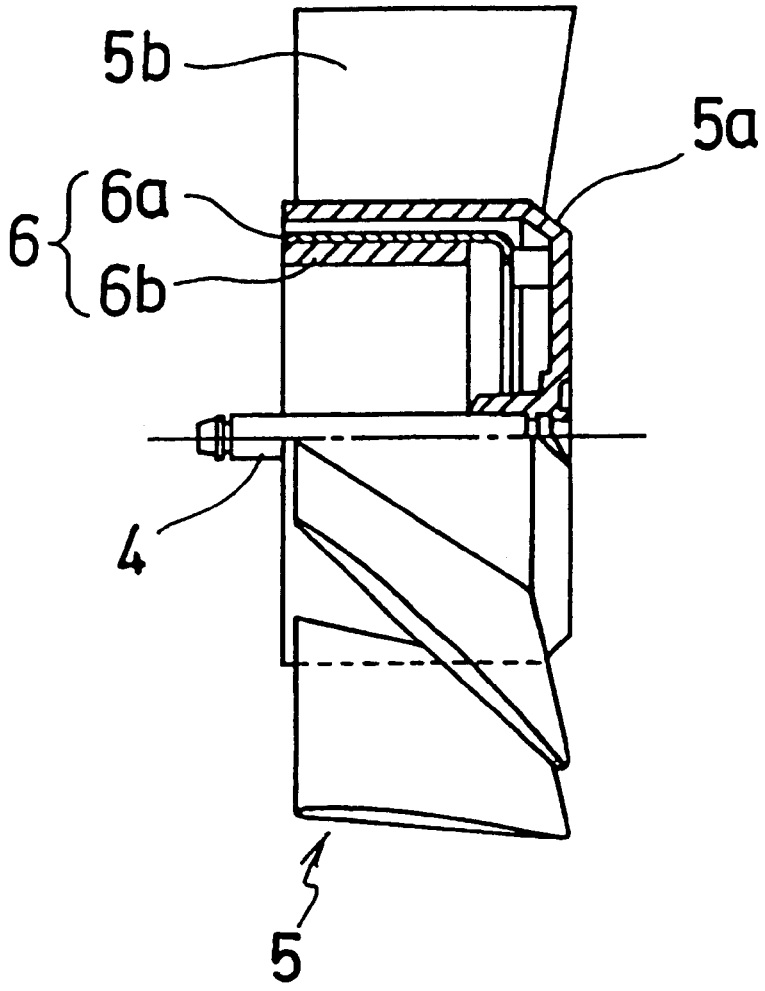
FIG. 12 is a partially cut-away sectional right side view of the rotor section in FIG. 11.

FIG. 8 shows the results of measuring the noise generated during the rotation of the impeller in which the front section impeller 5F having the nine impeller blades 5Fb and the rear section impeller 5R having the seven impeller blades 5Rb are arranged in series as described above. Also, FIG. 9 shows the result of measuring the noise generated during the rotation of an impeller in which the front and rear section impeller sections 5F and 5R having the same number of impeller blades 5Fb and 5Rb, respectively, are arranged in series, which impeller is not shown.

As can be understood by comparing both the drawings, in the case where the numbers of the impeller blades of the front and rear section impeller sections 5F and 5R are the same (FIG. 9), a measurement result was obtained such that a prominent noise peak 91 is generated at a frequency of around 600 Hz. On the other hand, in the case where the number of the impeller blades of the front section impeller 5F is nine and the number of the impeller blades of the rear section impeller 5R is seven FIG. 8), the noise peak 91 disappeared. In addition, the average noise level generated during the rotation of the impeller was 54.4 dB in the example shown in FIG. 8 in which the number of the impeller blades of the front section impeller 5F was more than that of the rear section impeller 5R; on the other hand, the average noise level in the example shown in FIG. 9, in which the numbers of the impeller blades of the individual impeller sections 5F and 5R are the same, was 55.7 dB. That is, the impeller of the present invention in which the number of the impeller blades of the front section impeller 5F is more than that of the rear section impeller 5R generates a noise level, which is 1.3 dB lower than the impeller in which the numbers of impeller blades of the individual impeller sections 5F and 5R are the same, and also the average noise level decreased.

In the present invention, the impeller is formed individually and the individual impeller sections are arranged in series to construct the entire impeller, and the individual impeller sections are placed so that the adjacent impeller blades do not overlap each other when seen from the axial direction. Accordingly, the impeller can be formed by molding with an axial coupling type die.

Also, according to the present invention, in the process of arranging the molded individual impeller sections in series (the assembly process), by setting the angular positions of the impeller blades of the front and rear section impeller sections in the direction around the shaft, modifications of the entire impeller can be provided.

Consequently, according to the present invention, the impeller structure in which the adjacent impeller blades overlap each other when seen from the axial direction can be easily and cheaply realized even though formed by synthetic resin molding.

In addition, according to the present invention, since the numbers of the impeller blades of the plurality of individual impeller sections are different, and more particularly, the number of the impeller blades of the front section impeller is more than the number of the impeller blades of the rear section impeller, the noise generated during the rotation of the impeller can be reduced.

That is, when the numbers of the impeller blades of the front and rear section impeller sections are the same (FIG. 9), a noise peak is generated at a frequency of around 600 Hz; on the other hand, when the number of the impeller blades of the front section impeller is nine and the number of the impeller blades of the rear section impeller is seven (FIG. 8), the noise peak disappeared. Also, the average noise level generated during the rotation of the impeller was lower in the impeller of the present invention, in which the number of the impeller blades of the front section impeller is more than that of the rear section impeller 5R, than that in the impeller in which the numbers of impeller blades of both the individual impeller sections are the same. The noise peak disappeared and also the noise generated during the rotation of the impeller was remarkably reduced; accordingly, generation of a harsh grating noise can be prevented.

What is claimed is:

1. An impeller of an axial-flow blower which is driven by an outer rotor type motor and which is integrated with a rotatably supported shaft and a motor yoke, the impeller and the motor yoke rotating outside the stator around the shaft to blow air, the impeller comprising:

a plurality of individual impeller sections, each section having a different number of impeller blades, the individual impeller sections being separately formed of a synthetic resin and arranged in series in the axial direction of the shaft without forming any steps.

2. The impeller of the axial-flow blower according to claim 1, wherein among the plurality of individual impeller sections that are adjacent with each other at the front and rear sides in the axial direction of the shaft, the number of the impeller blades of the front section impeller is more than that of the rear section impeller.

* * * * *